US012560376B2

(12) United States Patent
Caverno et al.

(10) Patent No.: US 12,560,376 B2
(45) Date of Patent: Feb. 24, 2026

(54) REFRIGERATOR APPLIANCE AND ADJUSTABLE AREA DISPENSER

(71) Applicant: Haier US Appliance Solutions, Inc., Wilmington, DE (US)

(72) Inventors: Katherine Michelle Caverno, Louisville, KY (US); Ryan Joseph Thomas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 243 days.

(21) Appl. No.: 18/532,421

(22) Filed: Dec. 7, 2023

(65) Prior Publication Data

US 2025/0189214 A1 Jun. 12, 2025

(51) Int. Cl.
*F25D 23/12* (2006.01)
*F25C 5/20* (2018.01)

(52) U.S. Cl.
CPC ..... *F25D 23/126* (2013.01); *F25C 5/22* (2018.01); *F25C 2400/04* (2013.01)

(58) Field of Classification Search
CPC ..... F25D 23/126; F25D 23/08; F25C 5/22; F25C 2400/04
See application file for complete search history.

(56) References Cited

U.S. PATENT DOCUMENTS

| | | | | |
|---|---|---|---|---|
| 8,640,483 | B2 | 2/2014 | Chase et al. | |
| 10,088,212 | B2 | 10/2018 | Miller et al. | |
| 10,287,115 | B2 | 5/2019 | Abbas et al. | |
| 2005/0056043 | A1 * | 3/2005 | Lee | F25D 23/025 62/340 |
| 2010/0180623 | A1 | 7/2010 | Oh | |
| 2015/0143837 | A1 * | 5/2015 | Zhang | F25D 23/12 62/344 |
| 2019/0383543 | A1 * | 12/2019 | Chandra | F25C 5/22 |

FOREIGN PATENT DOCUMENTS

| | | | |
|---|---|---|---|
| CN | 111295558 B | 2/2022 | |
| KR | 101091433 B1 | 12/2011 | |
| RU | 2198315 C2 | 2/2003 | |
| WO | WO-2014040899 A1 * | 3/2014 | F25D 23/126 |
| WO | WO2019092830 A1 | 5/2019 | |

OTHER PUBLICATIONS

WO-2014040899-A1 translation.*

* cited by examiner

*Primary Examiner* — Elizabeth J Martin
(74) *Attorney, Agent, or Firm* — Dority & Manning, P.A.

(57) ABSTRACT

A refrigerator appliance is provided, the appliance including an outer case forming a freezer compartment, a door hingedly attached to the outer case, and a dispenser assembly positioned at the door. The dispenser assembly includes a mouth forming at least a portion of an outlet opening. The mouth is slidably attached to a track. The track permits selective movement of the mouth at the outlet opening to vary an area of the outlet opening based at least on movement of the mouth.

16 Claims, 9 Drawing Sheets

REFRIGERATOR APPLIANCE AND ADJUSTABLE AREA DISPENSER

FIELD OF THE INVENTION

The present disclosure is related generally to refrigerator appliances, and more particularly to dispenser systems for refrigerator appliances.

BACKGROUND OF THE INVENTION

Refrigerator appliances generally include a refrigeration chamber and a freezer chamber. A dispenser may be included and configured to dispense ice and/or water to a user, such as a user's container. Dispensers may be positioned at a door or a panel at a refrigerator appliance casing. Dispensers may generally be recessed into the door or the panel. However, the recess may prevent access or positioning of containers larger than the recess to a dispenser mouth, switch, or exit area, which may cause some or all of the fluid or ice to miss the container, or cause the container to not contact the dispenser and therefore fail to dispense ice or fluid.

As such, there is a need for improved dispenser structures for refrigerator appliances.

BRIEF DESCRIPTION OF THE INVENTION

Aspects and advantages of the invention will be set forth in part in the following description, or may be apparent from the description, or may be learned through practice of the invention.

An aspect of the present disclosure is directed to a refrigerator appliance including an outer case forming a freezer compartment, a door hingedly attached to the outer case, and a dispenser assembly positioned at the door. The dispenser assembly includes a mouth forming at least a portion of an outlet opening. The mouth is slidably attached to a track. The track permits selective movement of the mouth at the outlet opening to vary an area of the outlet opening based at least on movement of the mouth.

Another aspect of the present disclosure is directed to a refrigerator appliance including a dispenser assembly having a mouth forming at least a portion of an outlet opening. The mouth is slidably attached to a track. The track permits selective movement of the mouth at the outlet opening to vary an area of the outlet opening based at least on movement of the mouth.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
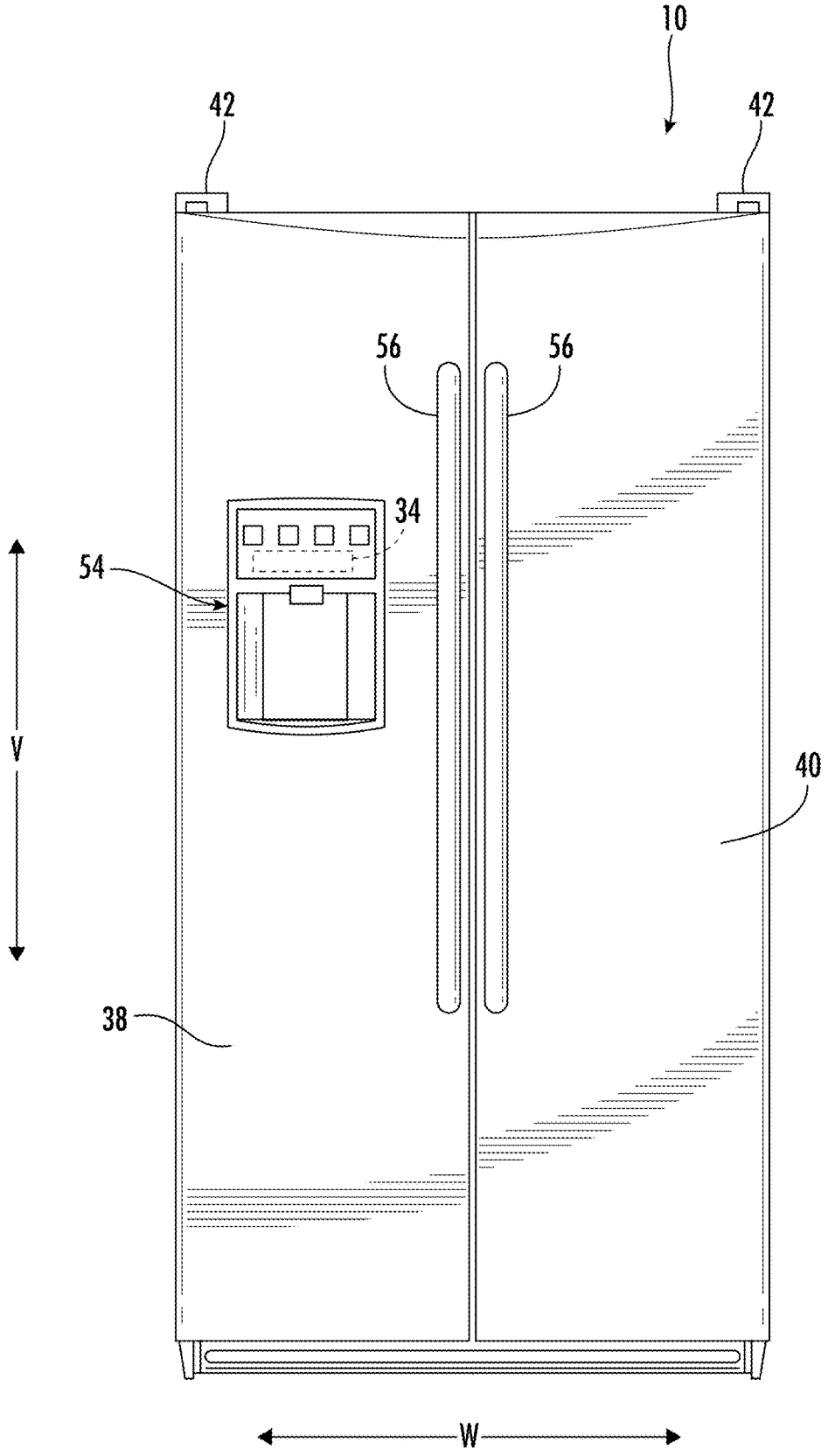
FIG. 1 is a perspective view of a refrigerator appliance according to an exemplary embodiment of the present subject matter with doors of the example refrigerator appliance shown closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
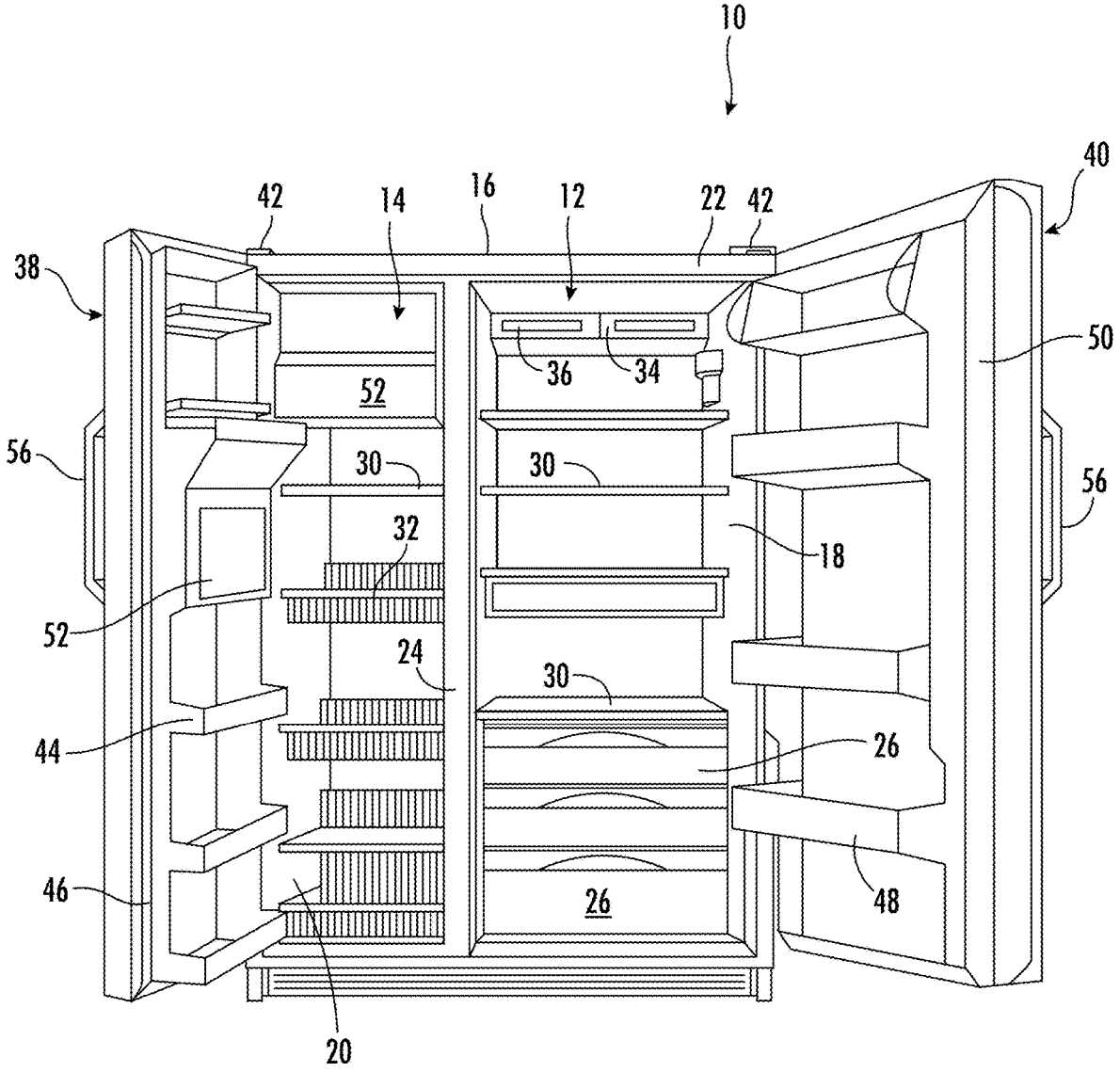
FIG. 2 is a perspective view of the exemplary refrigerator appliance with doors shown open.

FIG. 1 provides a perspective view of a refrigerator appliance 10 according to an exemplary embodiment of the present subject matter. FIG. 2 provides a perspective view of the refrigerator appliance 10 with doors 38, 40 open to view refrigeration and freezer compartments 12, 14 formed within an outer case 16.

Referring to FIG. 2, refrigerator appliance 10 includes the refrigeration compartment 12 and the freezer compartment 14, with the compartments arranged side-by-side and contained within the outer case 16. Outer case 16 and inner liners 18 and 20 are generally molded from a suitable plastic or foam material. For instance, the outer case may form a molded plastic or foam outer case. Thus, refrigerator appliance 10 is generally referred to as a side-by-side style refrigerator appliance. In alternative exemplary embodiments, refrigerator appliance 10 may include a single liner and a mullion that spans between opposite sides of the single liner to divide it into the freezer compartment 14, such as a compartment configured for frozen foods, and the refrigeration compartment 12, such as a compartment configured for fresh foods. Outer case 16 is normally formed by folding a sheet of a suitable material, such as pre-painted steel, into an inverted U-shape to form top and side walls of outer case 16. A bottom wall of outer case 16 normally is formed separately and attached to the case side walls and to a bottom frame that provides support for refrigerator appliance 10. However, it should be appreciated that outer case 16 may be formed by other suitable manufacturing methods. Furthermore, or alternatively, as depicted in FIGS. 13-15, embodiments of the refrigerator appliance 10 described herein may be formed in top-bottom arrangement, including, the freezer compartment 14 above or below the refrigeration compartment 12.

A breaker strip 22 extends between a case front flange and outer front edges of inner liners 18 and 20. Breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 may form a front face, and extend completely around inner peripheral edges of outer case 16 and vertically between inner liners 18 and 20.

Slide-out drawers 26 and shelves 30 are normally provided in refrigeration compartment 12 to support items being stored therein. In addition, a shelf 30, a basket 32, or both, are generally provided in freezer compartment 14.

Refrigerator appliance features are regulated with a controller 34 according to user preference via manipulation of a control interface 36 mounted in an upper region of refrigeration compartment 12 and coupled to controller 34. Input/output ("I/O") signals may be routed between controller 34 and various operational components of refrigerator appliance 10. The components of refrigerator appliance 10 may be in communication with controller 34 via one or more signal lines or shared communication busses.

Controller 34 can be any device that includes one or more processors and a memory. As an example, in some embodiments, controller 34 may be a single board computer (SBC). For example, controller 34 can be a single System-On-Chip (SOC). However, any form of controller 34 may also be used to perform the present subject matter. The processor(s) can be any suitable processing device, such as a microprocessor, microcontroller, integrated circuit, or other suitable processing devices or combinations thereof. The memory can include any suitable storage media, including, but not limited to, non-transitory computer-readable media, RAM, ROM, hard drives, flash drives, accessible databases, or other memory devices. The memory can store information accessible by processor(s), including instructions that can be executed by processor(s) to perform aspects of the present disclosure.

Referring to FIGS. 1-2, a freezer door 38 and a fresh food door 40 close access openings to freezer compartment 14 and refrigeration compartment 12. Freezer door and fresh food door 38 and 40 are each mounted by a top hinge 42 and a bottom hinge (not shown) to rotate about its outer vertical edge between an open position, as shown in FIG. 1, and a closed position. Freezer door 38 may include a plurality of storage shelves 44 and a sealing gasket 46, and fresh food door 40 also includes a plurality of storage shelves 48 and a sealing gasket 50.

Freezer compartment 14 may include an automatic ice maker 52 and a dispenser assembly 54 provided in freezer door 38 such that ice and/or chilled water can be dispensed without opening freezer door 38, as is well known in the art. Freezer door and fresh food door 38 and 40 may be opened by handles 56. It should be appreciated that the dispenser assembly 54 may be positioned at an exterior portion of the door, such as depicted in FIG. 1, or positioned in an interior portion, such as to require opening the door to access the dispenser assembly 54.

Refrigerator appliance 10 also includes a machinery compartment (not shown) that at least partially contains a cooling system including components for executing a known vapor compression cycle for cooling air. The cooling system may include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to direct cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
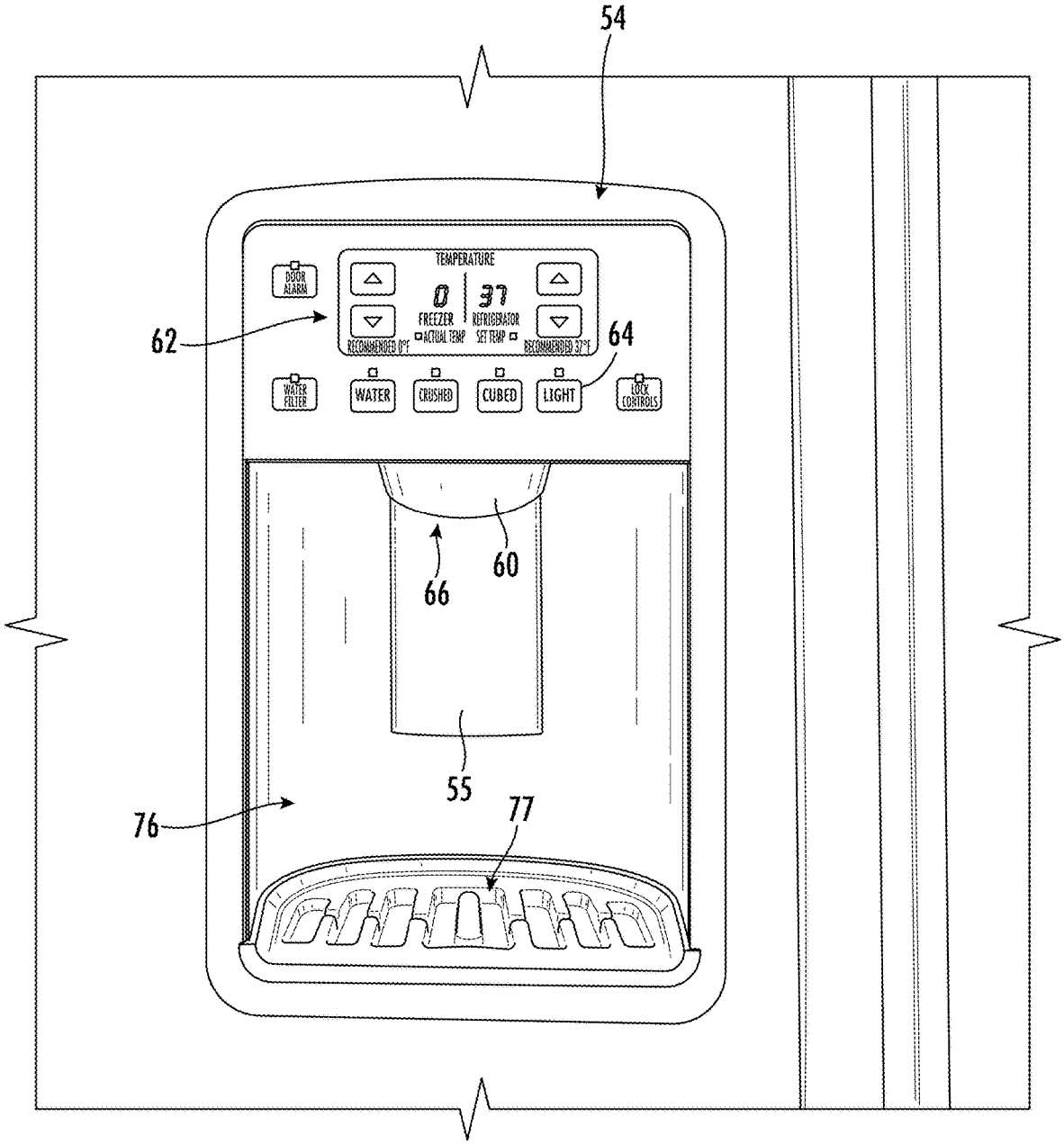
FIG. 3 is a front view of an exemplary dispenser assembly of the refrigerator appliance in accordance with aspects of the present disclosure.
Figure 5:
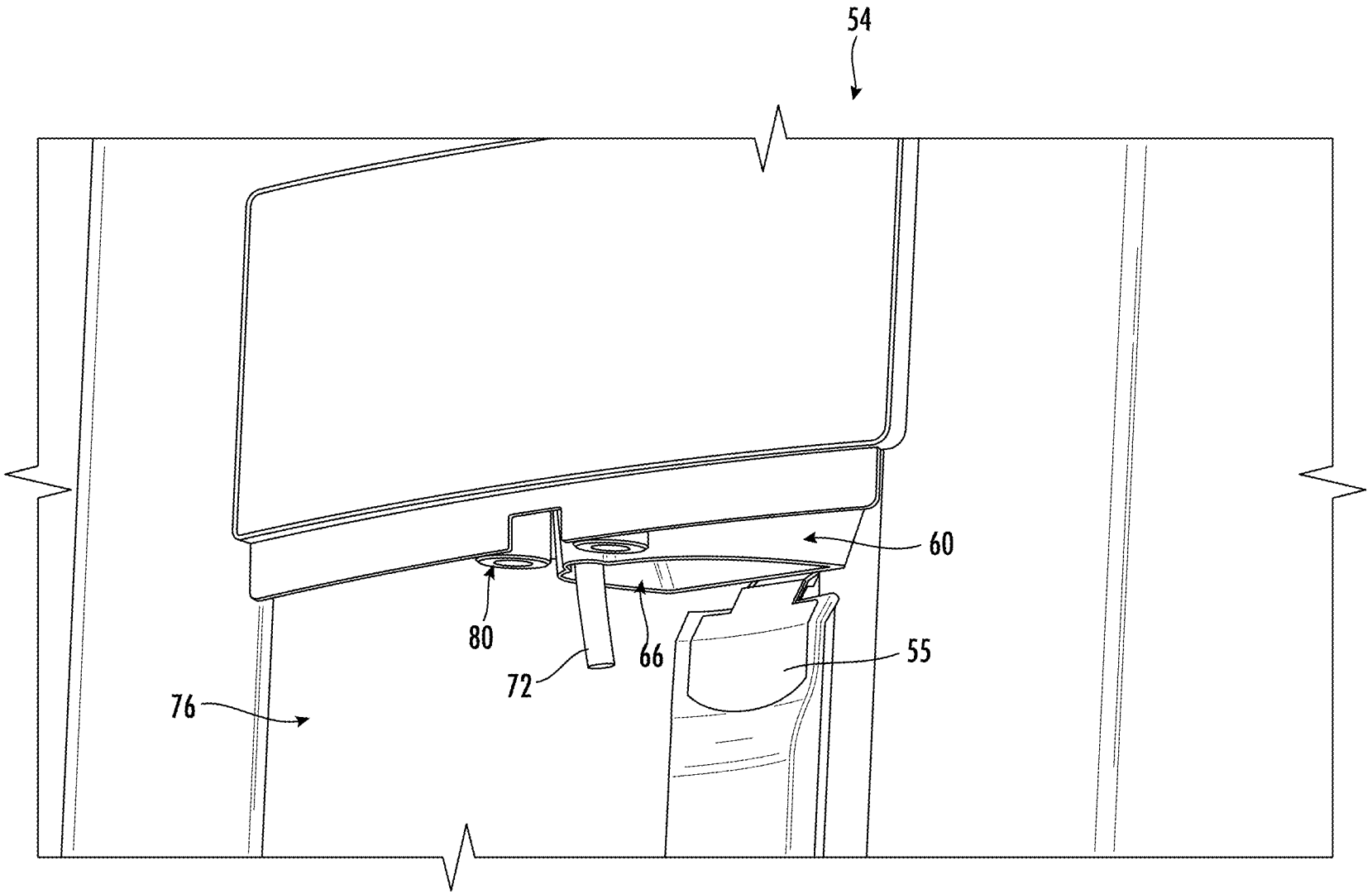
FIG. 5 provides a perspective view of an embodiment of the dispenser assembly in accordance with aspects of the present disclosure.

Referring to FIG. 3 and FIG. 5, a detailed view of an exemplary embodiment of the dispenser assembly 54 is provided. The dispenser assembly 54 may include a control panel 62 providing a display screen and a control interface 64, such as buttons, knobs, levers, or other interfaces at which a user may select one or more functions of the dispenser assembly 54. Functions may include, but not limited to, dispensing ice, selecting a type of ice to be dispensed (e.g., crushed or cubed), dispensing fluid (e.g., water), operating a light, etc. Control interface 64 may provide messages, such as, but not limited to, temperature, filter status, lock controls, etc.

The dispenser assembly 54 may include a dispenser control interface 55, such as a dispenser panel, configured to release ice or fluid when articulated. For instance, a user may position a container onto the dispenser control interface 55 to command release of ice or fluid from the dispenser assembly 54.

The dispenser assembly 54 includes a mouth 60 forming, at least in part, an outlet opening 66. The mouth 60 may generally form a wall forming a substantially enclosed channel 82 extending from an inlet to the outlet opening. The channel 82 forms a passage through which ice passes toward the user's container.

In some embodiments, a flap 58 is positioned at the outlet opening 66. In various embodiments, the flap 58 is configured to articulate to vary an area of the outlet opening 66, such as further described herein. The mouth 60 and the flap 58 may generally be positioned within a recess 76. A drain 77 is positioned within the recess 76 and below the mouth 60, such as to receive fluid or ice that may fall thereinto. A fluid nozzle 72 extends toward the drain 77 and is configured to dispense a fluid (e.g., water) to a container.

Figure 4A:
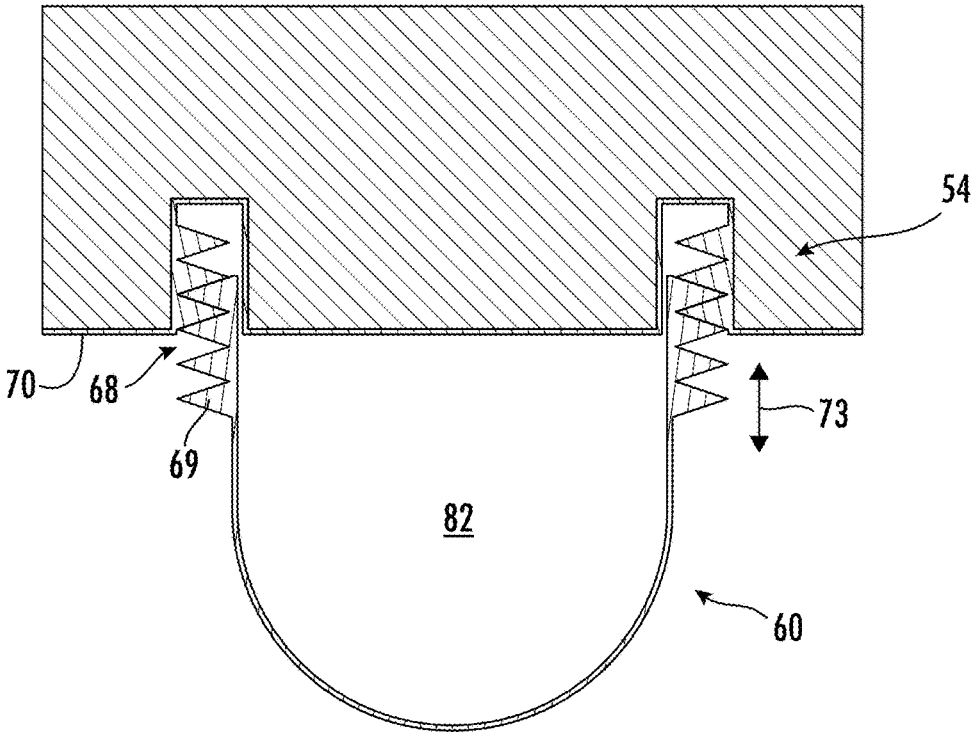
FIG. 4A is a top view of a portion of an embodiment of the dispenser assembly in a first position in accordance with aspects of the present disclosure.
Figure 4B:
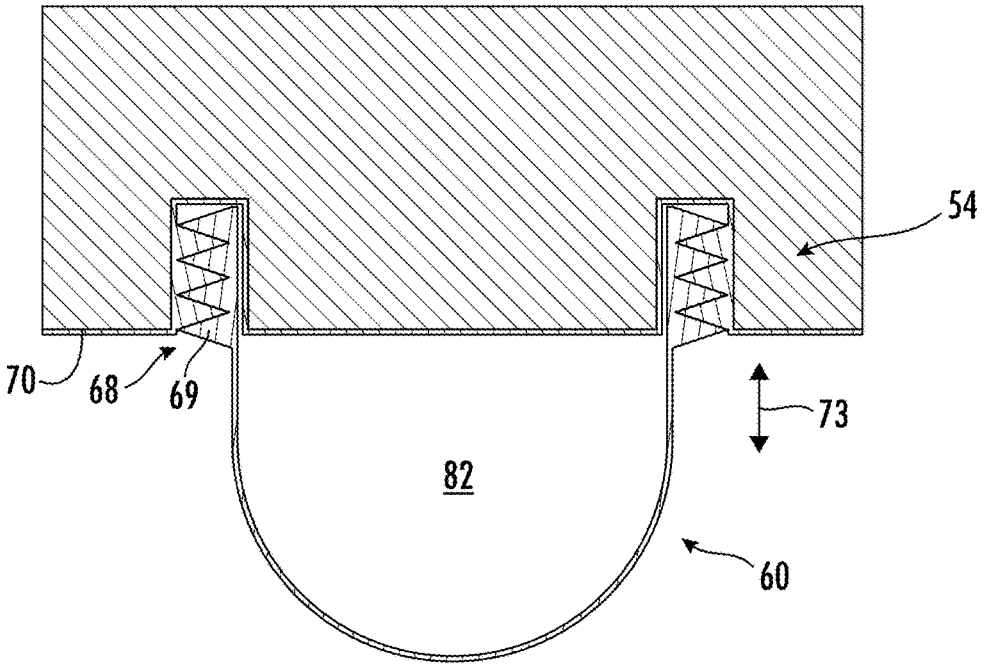
FIG. 4B is a top view of a portion of an embodiment of the dispenser assembly in a second position in accordance with aspects of the present disclosure.

Referring to FIGS. 4A-4B, an embodiment of a portion of the dispenser assembly 54 is provided. The dispenser assembly 54 can generally include a dispenser assembly wall 70. The wall 70 may form a static structure, such as a portion of the door 40, at which the dispenser assembly 54 is mounted. In various embodiments, the mouth 60 is slidably attached to a track 68. The track 68 permits selective movement of the mouth 60 to vary an area of the channel 82, the outlet opening 66, or both, based at least on movement of the mouth 60 that repositions the mouth 60 relative to the wall 70.

In some embodiments, the track 68 forms a mesh or gear interface between the dispenser assembly wall 70 and the mouth 60. The interface may include a plurality of teeth 69 contacting one another at the mouth 60 and the dispenser assembly wall 70. The plurality of teeth 69 mesh or engage one another and allow for movement along a transverse direction, such as provided via arrows 73. Transverse direction 73 may extend substantially perpendicular to lateral direction 71. Movement along the transverse direction 73 moves the mouth 60, such as to extend (FIG. 4A) or retract (FIG. 4B) to or from the wall 70. For instance, mouth 60 may extend or retract relative to the wall 70 and toward or away from the user, such as to increase or decrease a cross-sectional area of the channel 82. The track 68 may form a sawtooth track lockable in various positions along the mesh of teeth 69. Movement of the plurality of teeth 69 at the mouth 60 along the transverse direction 73 moves a wall forming the mouth 60 to vary the area of the outlet opening 66, such as to increase or decrease the area to guide the ice or fluid to the user's container.

Figure 6:
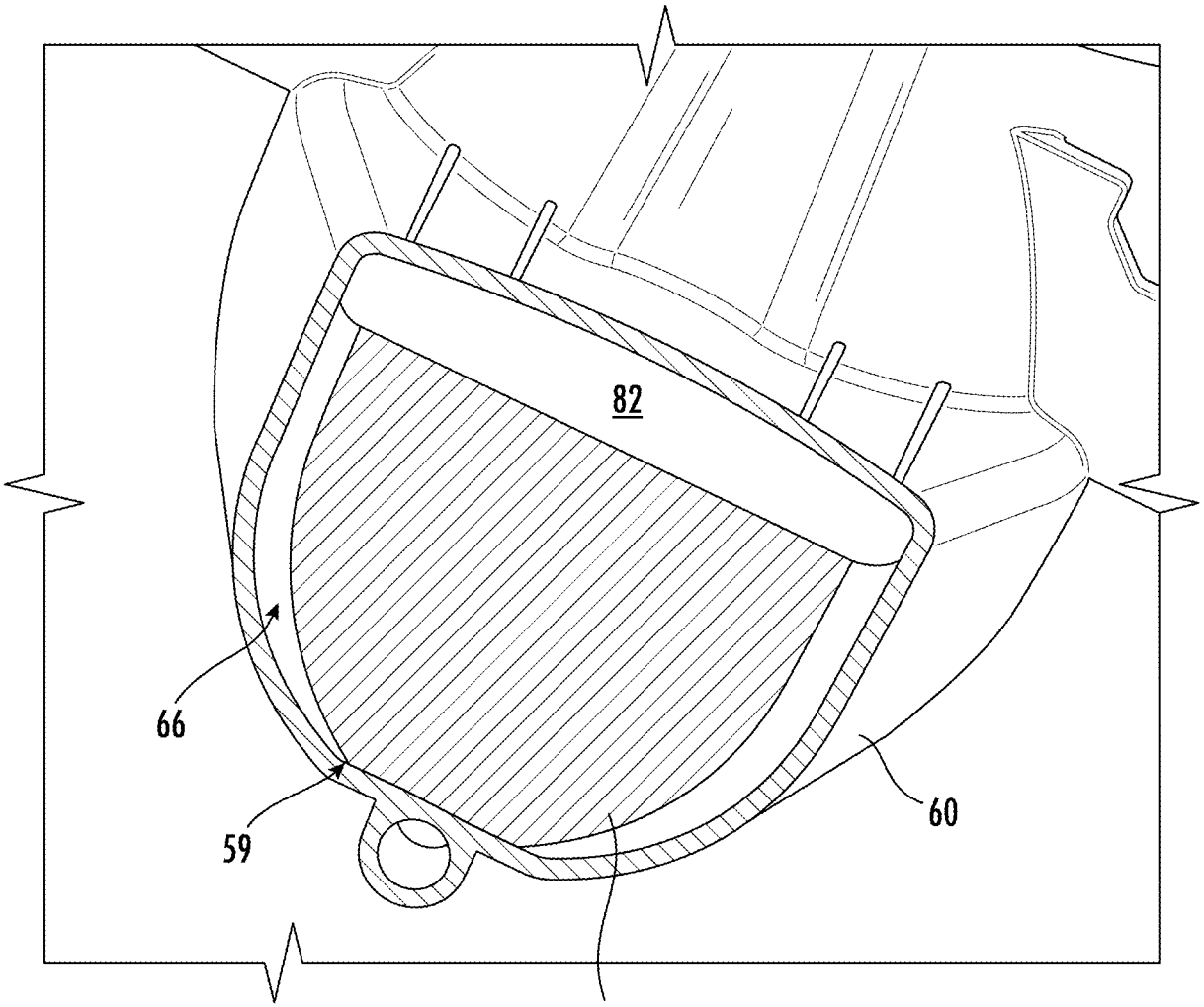
FIG. 6 provides a bottom-up view of an exemplary embodiment of the dispenser assembly in accordance with aspects of the present disclosure.
Figure 7:
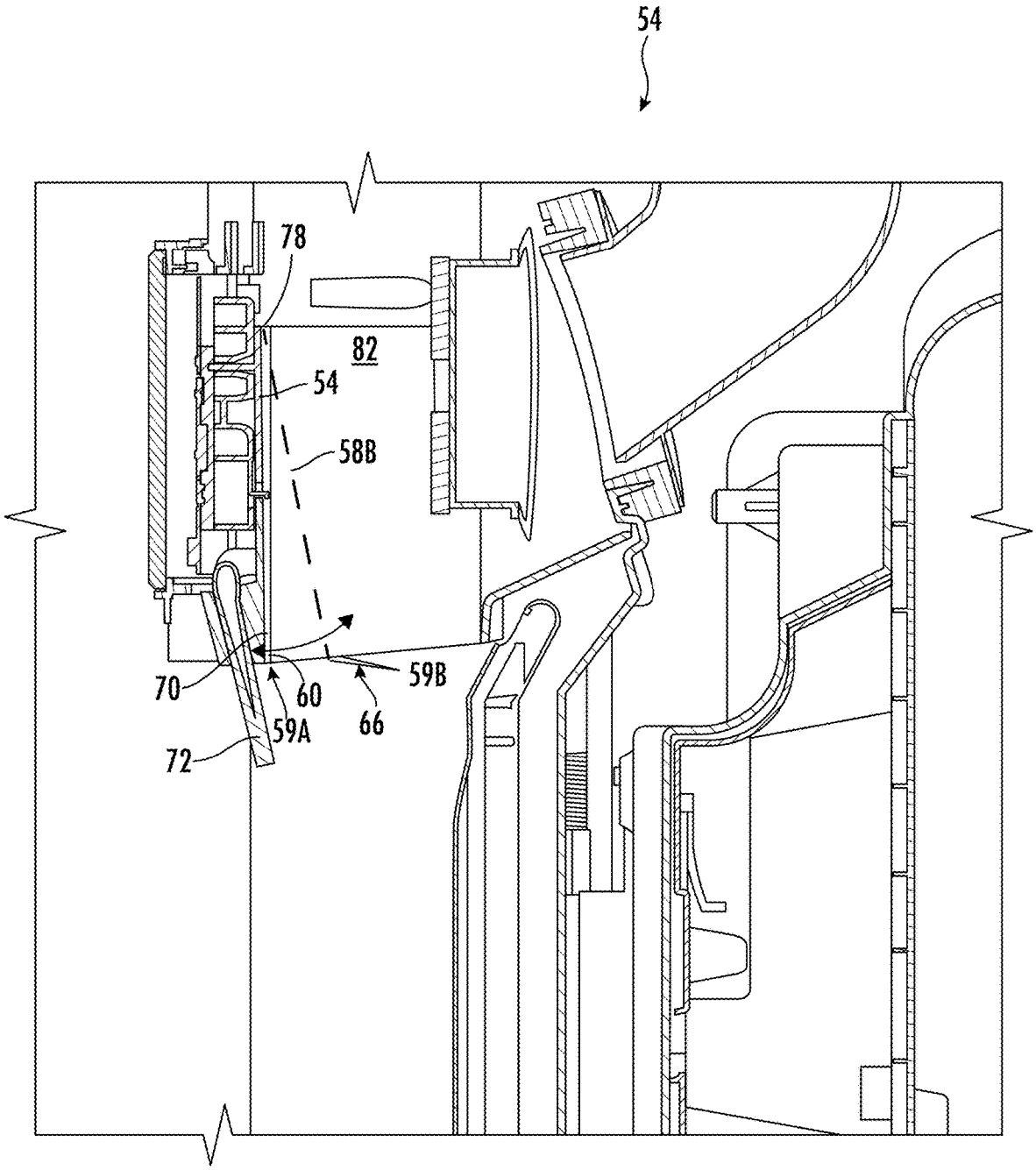
FIG. 7 provides a cross-sectional view of an exemplary embodiment of the dispenser assembly in accordance with aspects of the present disclosure.

Referring now to FIGS. 6-7, in various embodiments, the flap 58 is attached to the dispenser assembly wall 70 at a hinge 78. The flap 58 may form a portion of the outlet opening 66, such as along with the wall forming the mouth 60. Rotation of the flap 58 at the hinge 78 moves the flap 58 to vary the area of the outlet opening 66. In various embodiments, flap 58 includes a distal end 59 relative to the hinge 78. The distal end 59 is generally positioned proximate to which a container is to be received at the dispenser assembly 54. The hinge 78 is positioned in a channel 82 formed at the mouth 60. In various embodiments, the distal end 59 of the flap 58 from the hinge 78 is positioned at the outlet opening 66, Rotation of the flap 58 at the hinge 78 moves the distal end 59 of the flap 58 to vary the area of the outlet opening 66. For instance, FIG. 7 depicts the flap 58 in a first retracted position at 58A and a second retracted position at 58B. FIG. 7 furthermore depicts the distal end 59 in a first rotational position 59A and a second rotational position 59B distal from the dispenser wall 70.

Figure 8:
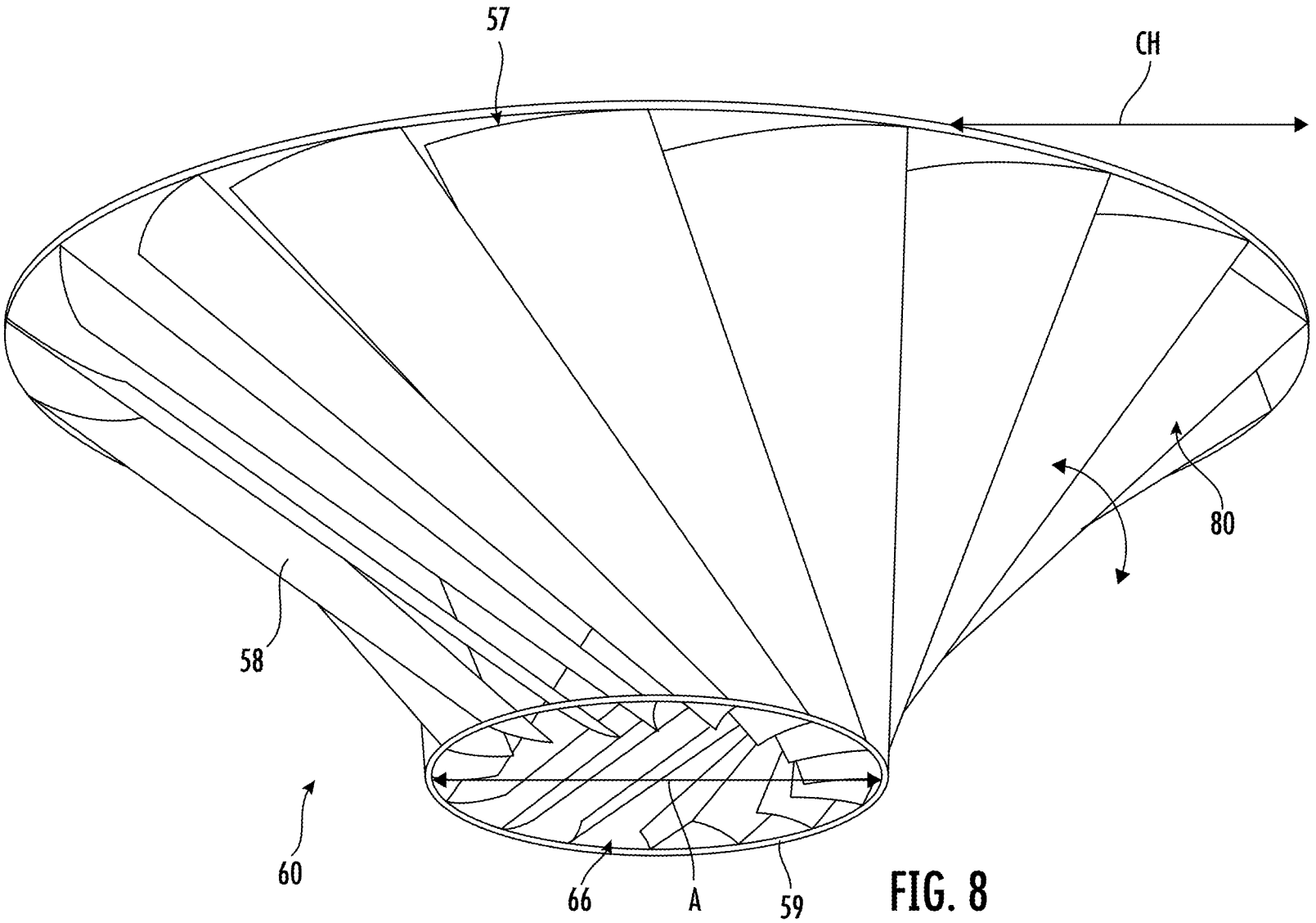
FIG. 8 provides a perspective view of an exemplary embodiment of a mouth of the dispenser assembly in accordance with aspects of the present disclosure.
Figure 9A:
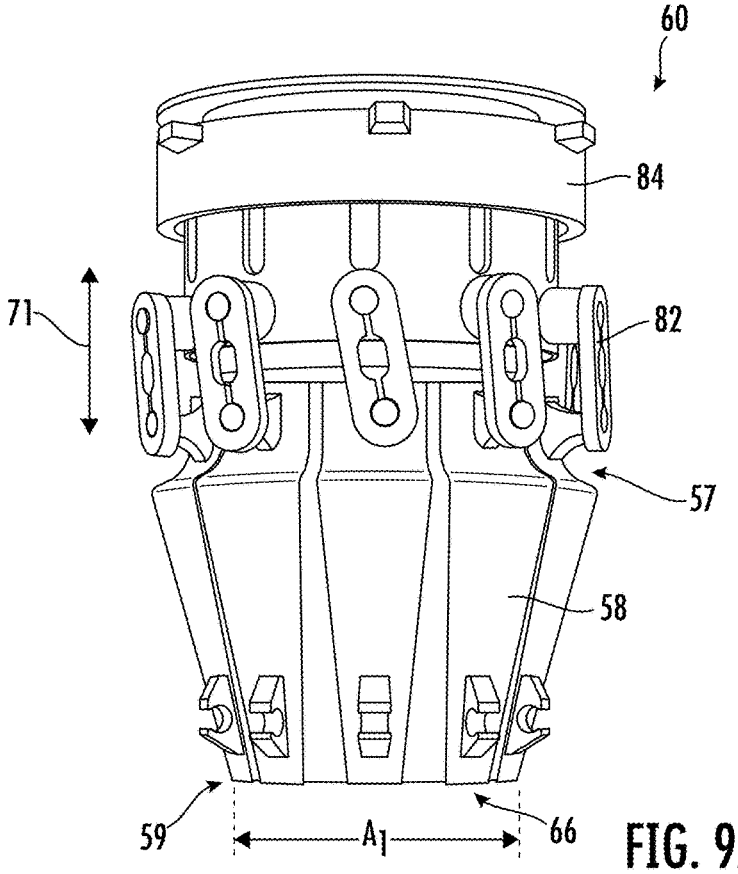
FIG. 9A is a side view of a portion of an embodiment of the dispenser assembly in a first position in accordance with aspects of the present disclosure.
Figure 9B:
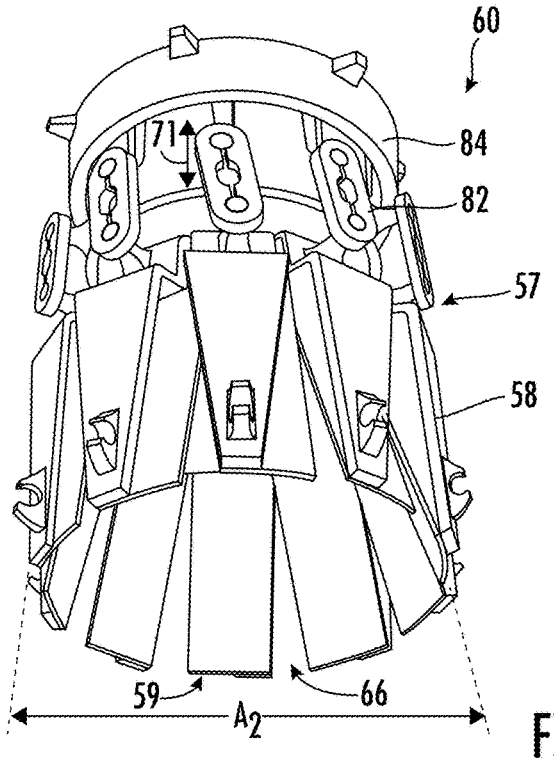
FIG. 9B is a perspective view of a portion of an embodiment of the dispenser assembly in a second position in accordance with aspects of the present disclosure.

Referring now to FIG. 8 and FIGS. 9A-9B, in various embodiments, the mouth 60 includes a plurality of flaps 58 forming a nozzle. The nozzle may form a converging-diverging nozzle configured to vary size of area of the outlet opening 66. Referring to FIG. 8, articulation of the plurality of flaps 58 along a chord CH causes the outlet opening 66 to change area. Chord CH may extend substantially perpendicular to lateral direction 71, such as substantially co-diretional to transverse direction 73. The plurality of flaps 58 may be arranged in a spiral formation such that a proximal end 57 of the flap 58 is offset along a circumferential direction from the distal end 59 of the respective flap 58. Articulation of the proximal end 57 along the chord CH adjusts area A of the outlet opening 66.

Referring to FIGS. 9A-9B, the mouth 60 may include the plurality of flaps 58 attached to a body 84 and a linkage 82. The linkage 82 is slidably attached to the body 84, such as to allow for articulation of the linkage 82 along a vertical or lateral direction 71 generally corresponding to a direction of ice or fluid egressing the appliance to the user's container. Articulation of the plurality of flaps 58 causes the outlet opening 66 to change area A, such as from area A1 depicted in FIG. 9A to a greater area A2 depicted in FIG. 9B. For instance, articulation may cause rotation of a ring at which the plurality of flaps 58 is connected, such as to cause the change in area between area A1 and area A2.

Articulation of the area of the outlet opening 66 such as provided herein allows for ice and fluid to more precisely direct to a container positioned at the dispenser assembly 54. Embodiments provided herein may facilitate reception of an oversized container at the dispenser assembly 54, such that ice and fluid can direct more accurately into a container that may be positioned further away from the outlet opening 66.

In some embodiments, the dispenser assembly 54 includes a proximity sensor 80, such as depicted at FIG. 5. The proximity sensor 80 is configured to determine presence of a container at the mouth 60. The proximity sensor 80 is operably coupled to the mouth 60 to transmit a signal to automatically adjust the area of the outlet opening 66 based on a position of the container, such as at the recess 76. In various embodiments, controller 34 is operably coupled to the proximity sensor 80, such as to receive a position signal from the proximity sensor 80 corresponding to a position of the container. The controller 34 is operably coupled to an actuation mechanism at the dispenser assembly 54, such as to transmit a control signal corresponding to a change in area at the outlet opening 66 based on the position signal.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

an outer case forming a freezer compartment;

a door hingedly attached to the outer case; and a dispenser assembly positioned at the door, the dispenser assembly comprising a mouth forming at least a portion of an outlet opening, wherein the mouth is slidably attached to a track, and wherein the track permits selective movement of the mouth at the outlet opening to vary an area of the outlet opening based at least on movement of the mouth, and wherein the mouth comprises a plurality of flaps forming a nozzle, wherein articulation of the plurality of flaps along a chord causes the outlet opening to change area.

2. The refrigerator appliance of claim 1, wherein the track comprises an interface between a dispenser assembly wall and the mouth.

3. The refrigerator appliance of claim 2, wherein the interface comprises a plurality of teeth contacting one another at the mouth and the dispenser assembly wall.

4. The refrigerator appliance of claim 3, wherein movement of the plurality of teeth at the mouth along a transverse direction moves the mouth to vary the area of the outlet opening.

5. The refrigerator appliance of claim 1, the dispenser assembly comprising a flap attached to a dispenser assembly wall at a hinge, wherein rotation of the flap at the hinge moves the flap to vary the area of the outlet opening.

6. The refrigerator appliance of claim 5, wherein the hinge is positioned in a channel formed at the mouth, and wherein a distal end of the flap from the hinge is positioned at the outlet opening, and wherein rotation of the flap at the hinge moves the distal end of the flap to vary the area of the outlet opening.

7. The refrigerator appliance of claim 1, the dispenser assembly comprising a proximity sensor, the proximity sensor configured to determine presence of a container at the mouth, wherein the proximity sensor is operably coupled to the mouth to adjust the area based on a position of the container.

8. A refrigerator appliance, comprising:

a dispenser assembly comprising a mouth forming at least a portion of an outlet opening, wherein the mouth is slidably attached to a track, wherein the track permits selective movement of the mouth at the outlet opening to vary an area of the outlet opening based at least on movement of the mouth, and wherein the mouth comprises a plurality of flaps forming a nozzle, wherein articulation of the plurality of flaps along a chord causes the outlet opening to change area.

9. The refrigerator appliance of claim 8, wherein the track comprises an interface between a dispenser assembly wall and the mouth.

10. The refrigerator appliance of claim 9, wherein the interface comprises a plurality of teeth contacting one another at the mouth and the dispenser assembly wall.

11. The refrigerator appliance of claim 10, wherein movement of the plurality of teeth at the mouth along a transverse direction moves the mouth to vary the area of the outlet opening.

12. The refrigerator appliance of claim 8, the dispenser assembly comprising a flap attached to a dispenser assembly wall at a hinge, wherein rotation of the flap at the hinge moves the flap to vary the area of the outlet opening.

13. The refrigerator appliance of claim 12, wherein the hinge is positioned in a channel formed at the mouth, and wherein a distal end of the flap from the hinge is positioned at the outlet opening, and wherein rotation of the flap at the hinge moves the distal end of the flap to vary the area of the outlet opening.

14. The refrigerator appliance of claim 8, the nozzle forming a converging-diverging nozzle at the outlet opening.

15. The refrigerator appliance of claim 8, the dispenser assembly comprising a proximity sensor, the proximity sensor configured to determine presence of a container at the mouth, wherein the proximity sensor is operably coupled to the mouth to adjust the area based on a position of the container.

16. The refrigerator appliance of claim 8, comprising:

an outer case forming a freezer compartment; and a door hingedly attached to the outer case, wherein the dispenser assembly is positioned at the door.

* * * * *